US007343275B2

(12) United States Patent
Lenormand et al.

(10) Patent No.: US 7,343,275 B2
(45) Date of Patent: Mar. 11, 2008

(54) METHOD FOR MODELLING THE PRODUCTION OF HYDROCARBONS BY A SUBSURFACE DEPOSIT WHICH ARE SUBJECT TO DEPLETION

(75) Inventors: Roland Lenormand, Rueil Malmaison (FR); Fabrice Bauget, Downer (AU)

(73) Assignee: Institut Francais du Petrole, Rueil Malmaison Cedex (FR)

( * ) Notice: Subject to any disclaimer, the term of this patent is extended or adjusted under 35 U.S.C. 154(b) by 345 days.

(21) Appl. No.: 10/508,206

(22) PCT Filed: Mar. 17, 2003

(86) PCT No.: PCT/FR03/00841

§ 371 (c)(1),
(2), (4) Date: Sep. 20, 2004

(87) PCT Pub. No.: WO03/078794

PCT Pub. Date: Sep. 25, 2003

(65) Prior Publication Data

US 2005/0165593 A1 Jul. 28, 2005

(30) Foreign Application Priority Data

Mar. 20, 2002 (FR) ..... 02 03437

(51) Int. Cl.

| | |
|---|---|
| ***G06G 7/48*** | (2006.01) |
| ***G01N 15/08*** | (2006.01) |
| ***G01V 1/40*** | (2006.01) |
| ***G01V 3/18*** | (2006.01) |
| ***G01V 5/04*** | (2006.01) |
| ***G01V 9/00*** | (2006.01) |
| ***G06F 19/00*** | (2006.01) |

(52) U.S. Cl. ..... 703/10; 702/13

(58) Field of Classification Search ..... 703/10; 702/13

See application file for complete search history.

(56) References Cited

U.S. PATENT DOCUMENTS 6,490,531 B1 * 12/2002 Goglin et al. ..... 702/25

OTHER PUBLICATIONS

Tsimpanogiannis et al.: An Effective Continuum Model For the Liqui-To-Gas Phase Change in a Porous Medium Driven By Solution Diffusion: Sep. 30, 2001.

(Continued)

*Primary Examiner*—Paul Rodriguez
*Assistant Examiner*—Nithya Janakiraman
(74) *Attorney, Agent, or Firm*—Antonelli, Terry, Stout & Kraus, LLP.

(57) ABSTRACT

A method for forming a model simulating production, by an underground reservoir subject to depletion, of hydrocarbons comprising notably relatively high-viscosity oils. From laboratory measurements of the respective volumes of oil and gas produced by rock samples from the reservoir subject to depletion, and the relative permeabilities (Kr) of rock samples to hydrocarbons, a model of the formation and flow of the gas fraction is used to determine a volume transfer coefficient (hv) by means of an empirical function representing the distribution of nuclei that can be activated at a pressure P (function N(P)) which is calibrated with reference to the previous measurements. Considering that the nuclei distribution N(P) in the reservoir rocks is the same as the distribution measured in the laboratory, the numerical transfer coefficient corresponding thereto in the reservoir at selected depletion rates is determined using the gas fraction formation and flow model, which allows predicting the relative permeabilities in the reservoir and the production thereof which is useful for reservoir engineering.

2 Claims, 3 Drawing Sheets

OTHER PUBLICATIONS

Arora et al. : "Mechanistic Modeling of Solution Gas Drive in Viscous Oils" Mar. 12, 2001.

Li et al. Visualization and Numericall Studies of Bubble Growth During Pressure Depletion. Oct. 6, 1991.

* cited by examiner

METHOD FOR MODELLING THE PRODUCTION OF HYDROCARBONS BY A SUBSURFACE DEPOSIT WHICH ARE SUBJECT TO DEPLETION

BACKGROUND OF THE INVENTION

1. Field of the Invention

The present invention relates to a method for modelling the production of hydrocarbons comprising notably relatively high-viscosity oils by petroleum reservoirs subjected to decompression or depletion.

2. Description of the Prior Art

The development of hydrocarbon reservoir production simulation generally involves several stages. Laboratory experiments are first interpreted. Then, the phenomena are modelled on the laboratory scale before an extrapolation is carried out on the reservoir scale. The quantities measurable on the laboratory scale and which have meaning on the reservoir scale therefore have to be determined (saturation, pressure, average concentration). The main requirement lies in the fact that the model must describe, for the same rock-fluids system, with the same parameters, experiments carried out under different conditions, that is for different depletion rate changes, withdrawal rate changes, etc. One of the main parameters is the relative permeability (Kr) which expresses the interactions between the reservoir fluids and the rock (FIG. 1). In water or gas drive methods, the relative permeabilities used for reservoir simulation are directly measured on cores (FIG. 2).

The mechanism of oil production from an underground hydrocarbon reservoir, by means of a decompression (well-known as solution gas drive) has been used and studied for a long time in the petroleum sphere. This production mechanism, which essentially produces oil saturated with light elements by depleting the reservoir, is either favored as in the case of viscous oils or avoided in the case of light oils, at least at reservoir production start, because it leads to an early production of gas and to a low recovery rate. However, in any case, modelling the reservoir production is necessary to control this mechanism.

Modelling of the production by depletion poses a specific problem for numerical simulations. Unlike the water and oil drive production methods, the relative permeabilities Kr measured in the laboratory on samples containing viscous oils cannot be directly used in numerical reservoir simulations. The reason is known and explained in many publications: on the one hand, the diffusion mechanism of the light constituent contained in the oil phase to the gas phase ("off equilibrium" transfer) and, on the other hand, the gas flow in the discontinuous form of bubbles or bubble strings. The consequence of these two effects is that the Kr values determined in the laboratory greatly depend on the experimental conditions, among other things the depletion rate (experiment duration).

Another well-known method of simulating foam flows in a modelled porous medium, known as "Population Balance Modelling", is described by Arora, P., Kovscek, A. R., 2001, *Mechanistic Modeling of Solution Gas Drive in Viscous Oils*, SPE 69717 International Thermal Operations and Heavy Oil Symposium, Porlamar, Margarita Island, Venezuela, March 12-14. The method introduces a large number of parameters: nucleation rate, bubble coalescence rate, rate of bubble formation during flow, which cannot be determined experimentally.

Pore network models are also known, which are notably described by Li, X., Yortsos, Y. C., 1991, *Visualization and Numerical Studies of Bubble Growth during Pressure Depletion*, SPE 22589 66$^{th}$ Annual Technical Conference and Exhibition, Dallas, Tex., October 6-9, based on a pore-scale physics and which therefore cannot simulate an experiment on the scale of a core and take into account of the boundary conditions specific to the experiments. These models have been tested only for light oils and they do not take into account dispersed gas flow.

The model described by Tsimpanogiannis, I. N., Yortsos, Y. C., 2001, *An Effective Continuum Model for the Liquid-to-Gas Phase Change in a Porous Medium Driven by Solute Diffusion: I. Constant Pressure Decline Rates*, SPE 71502 Annual Technical Conference and Exhibition, New Orleans, La., 30 September-3 October, is a model using continuous equations. It allows good understanding of the mechanisms involved in depletion production (solution gas drive): number of nucleated bubbles, maximum oversaturation, and their influence on the critical gas saturation. On the other hand, it uses a large number of parameters that cannot be directly measured, such as the number and the size of the bubbles. Furthermore, this model does not deal with the flow of the phases and the mass transfer throughout an experiment.

The model described by Sheng, J. J., *Foamy Oil Flow in Porous Media*, PhD Dissertation, University of Alberta, Edmonton, Canada, takes into account the equilibrium delay due to the growth and to the transfer between a dispersed gas and a continuous gas by means of exponential laws as in a chemical reaction. This method is also used in an industrial simulator (STARS). Such a solution does not show the physics of the phenomenon. It is difficult to interpret experiments in terms of physical parameters and therefore to be predictive. This approach takes into account a dispersed gas phase and a second, continuous phase. Again in this case, transfer between the two phases is governed by a chemical reaction type equation. Calibration is performed by adjusting parameters of the chemical reactions, parameters which are based on no physical justification. It is therefore impossible to predict parameters under reservoir conditions.

In general terms, no known model takes into account, within the scope of the solution gas drive process, and in a continuous approach, all of the mechanisms by allowing calculations under the reservoir flow conditions by using laboratory experiments.

SUMMARY OF THE INVENTION

The method according to the invention allows, from laboratory measurements on such samples and by means of suitable corrections described hereafter, realistic modelling of the production of a depleted reservoir, whatever the viscosity of the oils produced, and more particularly when it contains viscous oils, by using a commercially available compositional reservoir simulator.

The modelling method according to the invention allows simulation of production by an underground reservoir under the effect of depletion. It affords an excellent compromise between the accuracy to the physical mechanisms and modelling simplicity, in particular a small number of parameters that can be determined from a single laboratory experiment.

The method essentially comprises the following stages:

a) measuring in the laboratory respective volumes of oil and gas produced by rock samples from a reservoir and subjected to depletion, as well as relative permeabilities of rock samples to hydrocarbons;

b) determining, by a gas fraction formation and a flow model, a volume transfer coefficient by means of an empirical function representing the distribution of microbubbles or nuclei as a function of the pressure that is calibrated with reference to the previous measurements; and c) while considering that the distribution of microbubbles or nuclei in the reservoir rocks is identical to the distribution of the microbubbles deduced from the laboratory measurements, determining, by means of this gas fraction flow model, the numerical transfer coefficient that corresponds thereto in the reservoir at selected depletion rates, which allows prediction of the relative permeabilities in the reservoir and the reservoir production.

According to a preferred embodiment, the gas fraction flow model is essentially described by a parameter F characterizing the force required for untrapping the bubbles; a parameter $\alpha$ characterizing the change of the gas phase to the continuous form, the two parameters being determined by calibration from the laboratory measurements, and by the values of the relative permeability to the continuous gas fraction.

In the model obtained with the present method, the transfer is modelled by a volume transfer coefficient which has meaning on the laboratory scale and on the reservoir scale, whose dependence has been expressed as a function of the various parameters: gas saturation, oversaturation, liquid velocity.

By means of a two-stage procedure structured on a common significant parameter characterizing the nucleation of the gas phase, which is valid for the experimentally studied samples as well as for the rocks of the reservoir, the first stage being carried out with reference to laboratory measurements, it is possible to construct a predictive modelling tool allowing realistic representation of the conditions of flow of the viscous fractions of the oil in place in the reservoir.

BRIEF DESCRIPTION OF THE DRAWINGS

Other features and advantages of the method according to the invention will be clear from reading the description hereafter of a non limitative embodiment example, with reference to the accompanying drawings wherein.

DETAILED DESCRIPTION OF THE INVENTION

A first important point of the method of the invention relates to the "off-equilibrium" aspect of the light component transfer. It is based on modelling of the gas phase nucleation allowing prediction of the density of the bubbles and the pressure at which they appear. A law of distribution of the number of pre-existing "nuclei" or microbubbles as a function of the pressure is suggested. This empirical law N(P) takes into account the properties of the solid (surface roughness), the properties of the fluids and the physico-chemical interactions between the fluids and the solid (wettability for example). A relation form, for example exponential or power law, is imposed from the published measurements and the few parameters of this law (threshold pressure, exponent of the power law) are determined from the experiment by calibration. This law is considered valid at the laboratory stage as well as at the reservoir stage. From knowledge of this law N(P) and of the thermodynamic properties of the fluids (known properties), the method comprises a computing stage allowing determination of the transfer between the phase of the light component between the liquid and the gas. This computation takes into account the off-equilibrium difference and it therefore allows prediction of the evolution of the gas production with time, for any depletion rate.

The second point of the modelling method relates to the flow of the gas in a non-continuous form. Three possible situations for the gas are distinguished: either a phase trapped in form of bubbles or "bubble strings", or a mobile dispersed phase carried along by the oil flow, or a continuous phase flowing according to the conventional laws relative to flows in porous media (Darcy's law).

Based on known results in untrapping and bubble flow physics, the method allows producing a gas flow model described by a very small number of parameters that can be either calibrated on depletion experiments or measured separately:

a parameter F characterizing the force required for bubble untrapping (adhesion to the walls or capillary trapping), to be determined by calibration;

a parameter $\alpha$ characterizing the change of the gas phase to the continuous form. It has been shown by several authors that the saturation at which the gas goes into the continuous form Sgc is a law expressed as a power of the depletion rate. Parameter $\alpha$ is the exponent of this power law, assumed to be the same for a sample and a given oil, whatever the experiment conditions, to be determined by calibration also; and the values of the relative permeability to the continuous gas, measured by conventional injection drive methods.

The flow model provided allows calculation of the flow properties (critical saturations, gas flow, etc.) as a function of constants F and $\alpha$, of the properties of the fluids and of the experimental conditions (velocity of flow, depletion rate, etc.).

Figure 1:
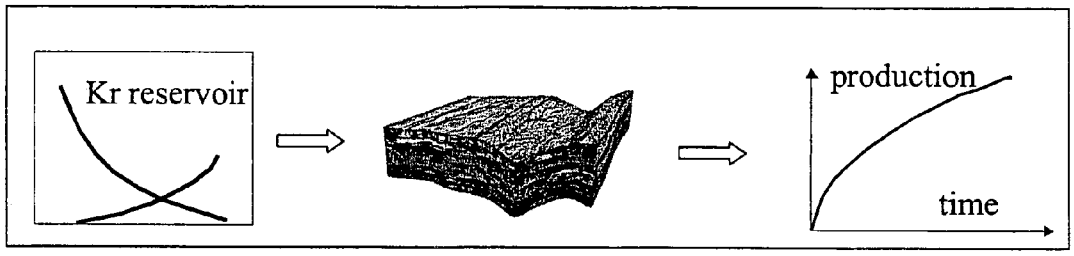
FIG. 1 illustrates the principle of a petroleum reservoir production simulation, the main useful parameter being the relative permeability which expresses the interactions between the fluids (water, oil or gas) and the rock.
Figure 2:
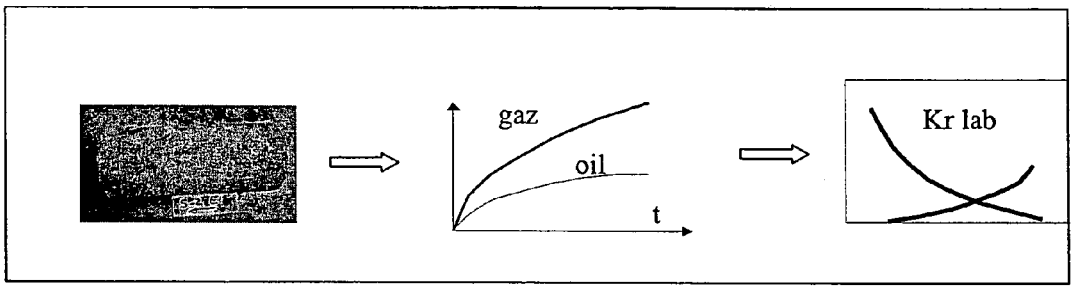
FIG. 2 shows, for water or gas drive methods, the experimental scheme allowing obtaining, from measurements on samples, relative permeabilities Kr suitable at the laboratory stage as well as in the reservoirs.
Figure 3:
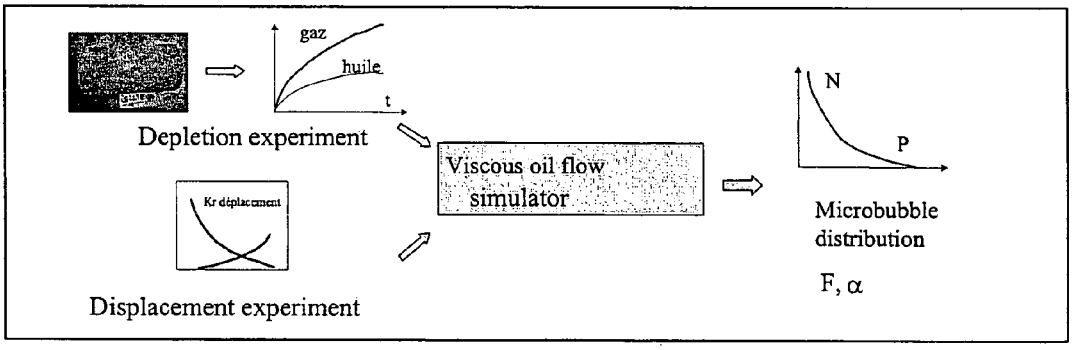
FIG. 3 illustrates the principle of determination of the characteristic parameters of flow of an oil by depletion from laboratory experiments, which is the object of the first essential stage of the method.
Figure 4:
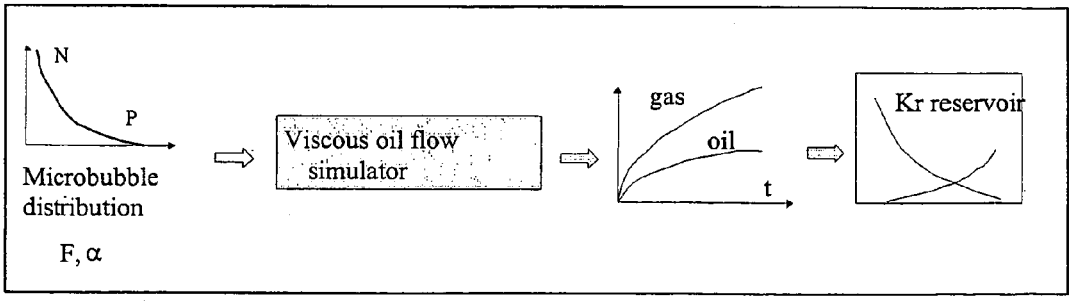
FIG. 4 shows the principle of use of a flow simulator for carrying out a numerical experiment under reservoir conditions allowing determination of "reservoir Kr" values, which is the object of the second essential stage of the method.
Figure 5:
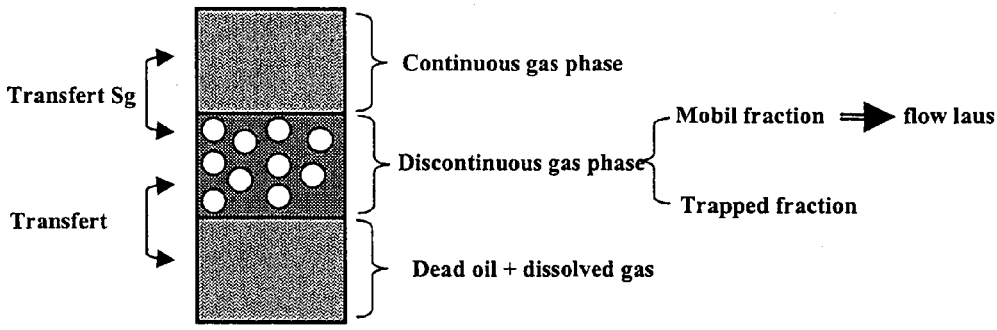
FIG. 5 diagrammatically shows the various "pseudo"-stages present in the porous medium (the residual water phase is not mentioned but it exists.

Coupling of the transfer model with the flow model allows simulation of an experiment in any condition. It is used in two stages respectively illustrated by FIGS. 3 and 4:

1) with the conditions of the experiments carried out in the laboratory, determination of the characteristic parameters F, α and N(P) by calibration (modification of the parameters until an agreement is obtained between the real and the simulated experiment);

2) with the reservoir conditions, predictive operation that is "numerical" experiment that can be carried out at very slow depletion rates for example. The "reservoir" relative permeabilities are then determined by means of a standard calibration method, exactly as for a real experiment.

Transfer Function Dependence Determination

Growth by diffusion in the case of a depleted liquid is controlled by the concentration gradient at the surface of the bubbles. In a continuous approach, this local gradient is not accessible and it is replaced by a surface transfer coefficient $h_s$. The transfer flow density is assumed to be proportional to the difference between the equilibrium value $C_{eq}$ at the bubble interface and the average concentration C in the liquid. Transfer coefficient $h_s$ allows to calculate the flow density ϕ:

$$\phi = h_s(C - C_{eq}) \tag{1}$$

with ϕ ($mol \cdot m^{-2} \cdot s^{-1}$), $h_s$ ($m \cdot s^{-1}$). Introduction of a transfer coefficient to replace a local gradient is a relatively common procedure in physics.

Hereafter an expression for $h_s$ as a function of characteristic quantities in the case of the growth of a spherical bubble population in an infinite medium is determined.

A fluid volume V (liquid+gas) is considered. The pressure in the gas is P. The total surface area of the bubbles in this volume is denoted by s and $N_0$ is the total number of bubbles per volume unit of fluid. All the bubbles are assumed to have the same radius r.

Total volume of the bubbles:

$$V_G = N_0 V \frac{4\pi r^3}{3} \tag{2}$$

Surface area of the bubbles:

$$s = N_0 V 4\pi r^2 \tag{3}$$

The radius can be eliminated by expressing the surface area as a function of the volume:

$$s = N_0 V 4\pi \left(\frac{3V_G}{N_0 V 4\pi}\right)^{2/3} \tag{4}$$

By definition of the flow surface density:

$$\frac{dn}{dt} = \varphi \cdot s \tag{5}$$

Henry's law:

$$C_{eq} = k_s P \tag{6}$$

An equation for spherical bubbles is then obtained as follows:

$$\frac{dn}{dt} = h_s N_0 V 4\pi \left(\frac{3V_G}{N_0 V 4\pi}\right)^{2/3} (C - k_s P) \tag{7}$$

An estimation of the surface transfer coefficient $h_s$ can be given by replacing the gradient at the wall in the local approach by a mean gradient, using the mean distance d between bubbles:

$$h_s \approx \frac{D}{d} \tag{8}$$

The mean distance between bubbles is expressed as a function of the number of bubbles $N_0$ per unit volume:

$$d^3 = 1/N_0 \tag{9}$$

Hence finally:

$$\frac{dn}{dt} = D N_0^{1/3} N_0 V 4\pi \left(\frac{3V_G}{N_0 V 4\pi}\right)^{2/3} (C - k_s P) \tag{10}$$

and, if simplified:

$$\frac{dn}{dt} = a D N_0^{2/3} V^{1/3} V_G^{2/3} (C - k_s P) \tag{11}$$

where a is a constant $$a = (41\pi)^{1/3} 3^{2/3} \approx 4.84 \tag{12}$$

Changing to Darcy's Scale

On Darcy's scale, the inner surface of the bubbles is not known. Therefore a "volume" transfer coefficient $h_v$ defined as a function of the flow of moles per volume unit of fluid is defined as:

$$\Phi = h_v(C - C_{eq}) \tag{13}$$

The dimension of $h_v$ is $(time)^{-1}$. In order to show the dependence of $h_v$ as a function of the various "microscopic" parameters of the experiment, this law is identified with the result of the previous calculation, Equation (11):

$$\Phi = \frac{1}{V}\frac{dn}{dt} = h_v(C - C_{eq}) \tag{14}$$

hence:

$$h_v \approx a D N_0^{2/3} V^{-2/3} V_G^{2/3} \tag{15}$$

The gas saturation ($S = V_g/V_{total}$) can also be introduced:

$$h_v \approx a D N_0^{2/3} S_G^{2/3} \tag{16}$$

It has to be noted that this result is obtained with a greatly simplified model of equidistant bubbles of uniform size. But it allows explaining the dependence as a function of the various parameters: gas saturation, bubble density and molecular diffusion. In practice, the prefactor as well as the powers can be adjusted.

Thus a relation exists that gives the evolution of the number of gas moles. In problems related to porous media, it is more demanding to work with variables such as saturations. Using the perfect gas law allows showing the gas saturation rather than the number of moles. The perfect gas law gives:

$$n = \frac{PV_g}{RT} \tag{17}$$

Therefore substituting n in Equation (14) provides:

$$\frac{d(PS_G)}{dt} = h_v RT(C - C_{eq}) \tag{18}$$

A continuous equation is obtained which gives the evolution of the mass transfer between a fluid saturated with light elements and the gas phase. It involves, which is an important point of the approach selected, only mean variables which have a physical meaning in Darcy's approach.

It is seen that the volume transfer coefficient $h_v$ first depends on the number of bubbles, which itself depends on the oversaturation. In order to determine from the experiments this transfer coefficient by means of the calibration technique the results obtained on the finer scale of Relation (7) are used.

Nucleation is an important mechanism and, on this scale, the only means to take it into account is to introduce a site size distribution. In this model, this amounts to making $N_0$ dependent on oversaturation ΔP. In the model, the approach described by Yang, S. R., et al., 1988, *A mathematical Model of the Pool Boiling Nucleation Site Density in Terms of the Surface Characteristics*, International Journal of Heat and Mass Transfer, 31(6), 1127-1135, is used by introducing an exponential law:

$$N_0 \propto \exp\left(-\frac{\delta}{P - P_{eq}}\right) \tag{19}$$

However, this equation has to be modified in order to take into account of the oversaturation threshold $\Delta P_{threshold}$:

$$N_0 = 0 \text{ for } P - P_{eq} \geq \Delta P_{threshold}.$$

$$N_0 \propto \exp\left(-\frac{\delta}{\Delta P_{threshold}}\right) - \exp\left(-\frac{\delta}{\Delta P_{threshold}}\right) \tag{20}$$

$$\text{for } P - P_{eq} \leq \Delta P_{threshold}$$

Now, from Equation (16), $h_v$ depends on $N_0$:

$$h_v \approx aDN_0^{2/3}S_G^{2/3} \tag{21}$$

As mentioned above, exponent ⅔ results from the surface/volume ratio of the bubbles and it can be modified to take into account of a branched (fractal) shape of the bubbles in the porous medium. Therefore replacement next by a more general exponent d occurs if necessary.

$$h_v(S_g) = S_g^d \beta D\left[\exp\left(\frac{\delta}{P - P_{eq}}\right) - \exp\left(\frac{\delta}{\Delta P_{threshod}}\right)\right]^d \tag{22}$$

Since this model shows the size distribution of the nucleation sites, constants d and β have to be the same for the same fluid and the same sample.

As already mentioned above, the convective effect has to be taken into account; a term depending on the Peclet number is therefore added to $h_v$ as follows:

$$Pe = \frac{V1}{D} \tag{23}$$

$$h_v = A + BPe^{\alpha} \tag{24}$$

This is a model with adjustable parameters. It is more predictive than the model obtained by the pore-scale approach or by reservoir simulators. There is only one set of parameters for a single experimental device (rock and fluids). Besides, this transfer coefficient has a real physical meaning in the same way as a capillary pressure curve, and it can therefore characterize a rock-fluid system in the case of a solution gas drive process. This transfer curve $h_v(S_g)$ is experimentally determined.

Gas Phase Flow

Discontinuous Gas Phase

If the mechanism of mobilization of the nodules of a non-wetting fluid by a second wetting fluid as the basis is taken, there is a critical untrapping size which corresponds to a threshold saturation denoted by $S_g^{mob}$. The trapped gas fraction is taken equal to $S_g^{mob}$. It is assumed that the mean velocity of the clusters is proportional to that of the continuous fluid. Besides, it is coherent to assume that this flow will depend on the viscosity ratio of the two fluids. This allows using, for the same rock, the same proportionality coefficient for two oils of different viscosity. The formulation implanted in the simulator with these assumptions is $$f_g = F\frac{\mu_g}{\mu_o}(S_g - S_g^{mob})u_o \text{ for } S_g > S_g^{mob} \tag{25}$$

$$f_g = 0 \text{ for } S_g < S_g^{mob}$$

$$f_g = 0 \text{ for } S_g < S_g^{mob}$$

with F proportionality coefficient, μ gas and oil viscosities.

Continuous Gas Phase

From a saturation threshold value, denoted $S_g^*$ here, a fraction of the gas is connected, Darcy can then apply. The relative permeability used can be the relative permeability of a displacement experiment taken for a saturation of $(S_g - S_g^*)$. It is then obtained for the gas flow:

$$f_g = 0 \qquad \text{for } S_g \leq S_g^{mob} \tag{26}$$

$$f_g = c^{ste}(S_g - S_g^{mob})u_o \qquad \text{for } S_g^* \geq S_g \geq S_g^{mob}$$

$$f_g = c^{ste}(S_g^* - S_g^{mob})u_o + \frac{kk_{rg}(S_g - S_g^*)}{\mu_g}\frac{\partial P}{\partial x} \qquad \text{for } S_g \geq S_g^*$$

Oil Phase Flow

The oil phase being continuous, the Darcy formalism is applied thereto. The relative oil permeability will be determined in a displacement experiment.

System of Equations

With the various mass balances for the oil, the gas and the light elements concentration in the oil, it is obtained:

For the oil:

$$\Phi\frac{\partial}{\partial t}(\rho_0 S_0) + \frac{\partial}{\partial x}(\rho_0 u_0) = 0 \tag{26}$$

For the gas:

$$\Phi\frac{\partial}{\partial t}(PS_g) + \frac{\partial}{\partial x}(Pf_g) = \Phi RTh_v(S_g)(C - k_s P) \tag{27}$$

For the concentration in the oil:

$$\Phi\frac{\partial}{\partial t}(CS_0) + \frac{\partial}{\partial x}(Cu_0) = -\Phi h_v(S_g)(C - k_s P) \tag{28}$$

In Equation (27), the pressure appears through the expression of the gas density, the gas being considered to be a perfect gas.

Adjustment of the Model to the Experimental Results

Figure 6:
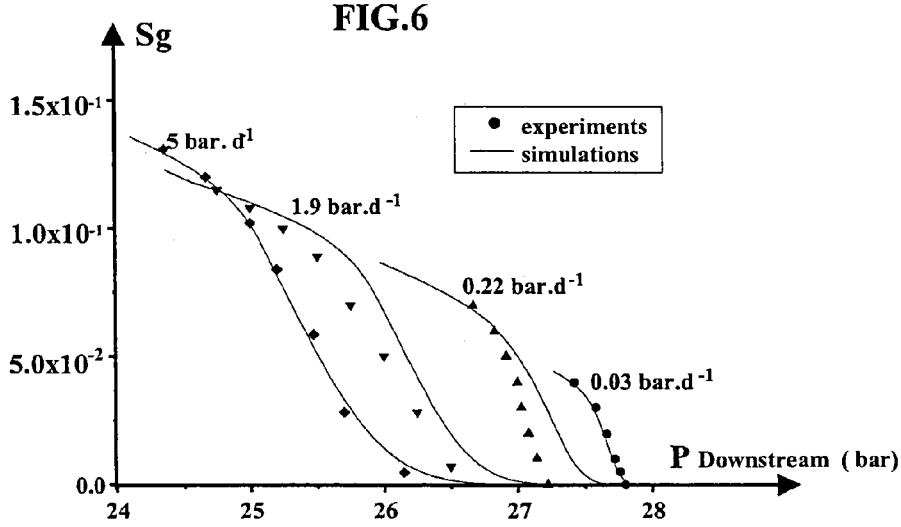
FIG. 6 shows simulation examples for a light $C_1$-$C_3$-$C_{10}$ oil.

FIG. 6 shows simulation examples for a $C_1$-$C_3$-$C_{10}$ light oil. A good agreement is obtained for the various depletion rates. The model has been calibrated on the extreme depletion rates. The same parameters have been used for all of the simulations.

In order to confirm the validity of the model for viscous oils, two series of simulations were carried, without convective effects.

Figure 7:
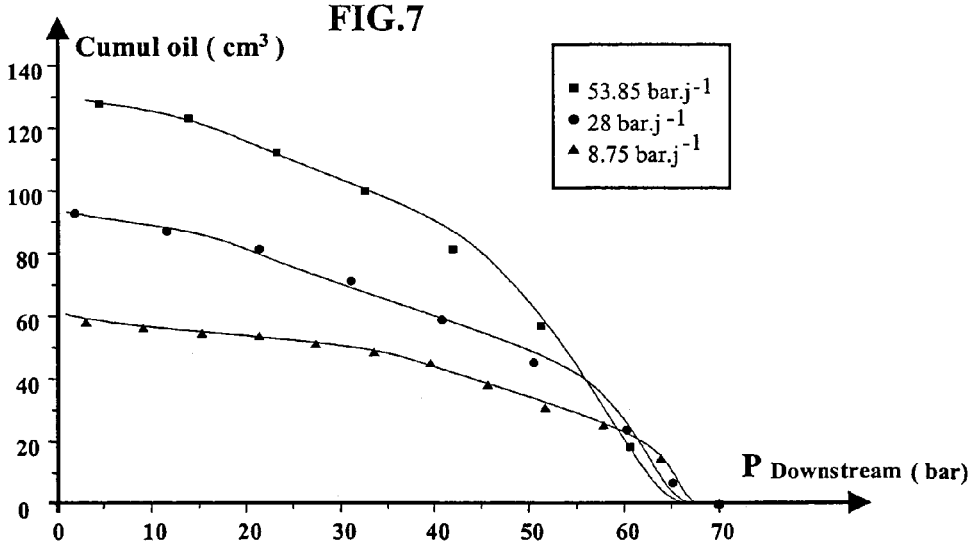
FIGS. 7 and 8 show a first series of simulations carried out for different viscous oils (250 cp and 3300 cp) in the same rock type.
Figure 8:
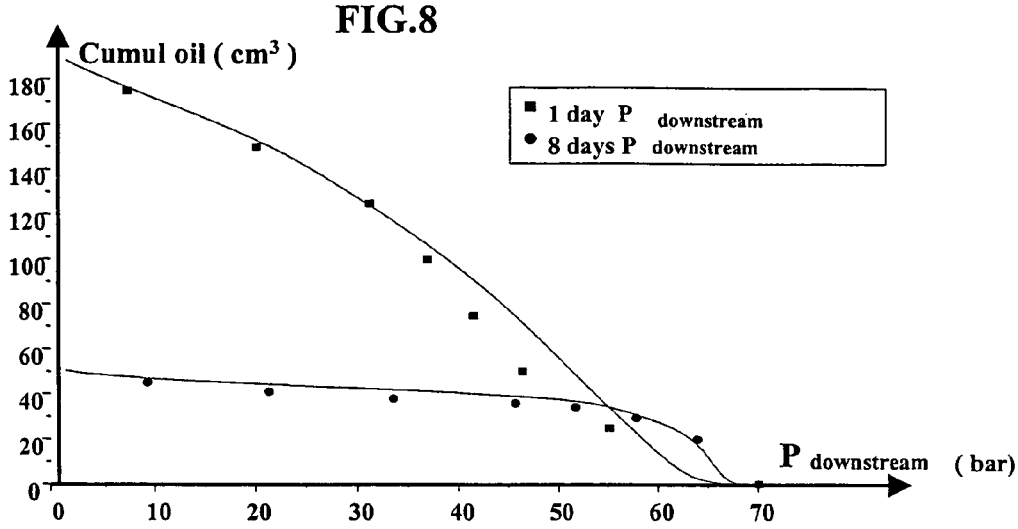

FIGS. 7 and 8 show the first series of simulations. In both cases, the rock is the same, but the oils are different. Calibration has been performed on the two extreme rates of FIG. 7. The same set of parameters has been used for all of the simulations, only $S_g^{mob}$ is different.

Figure 9:
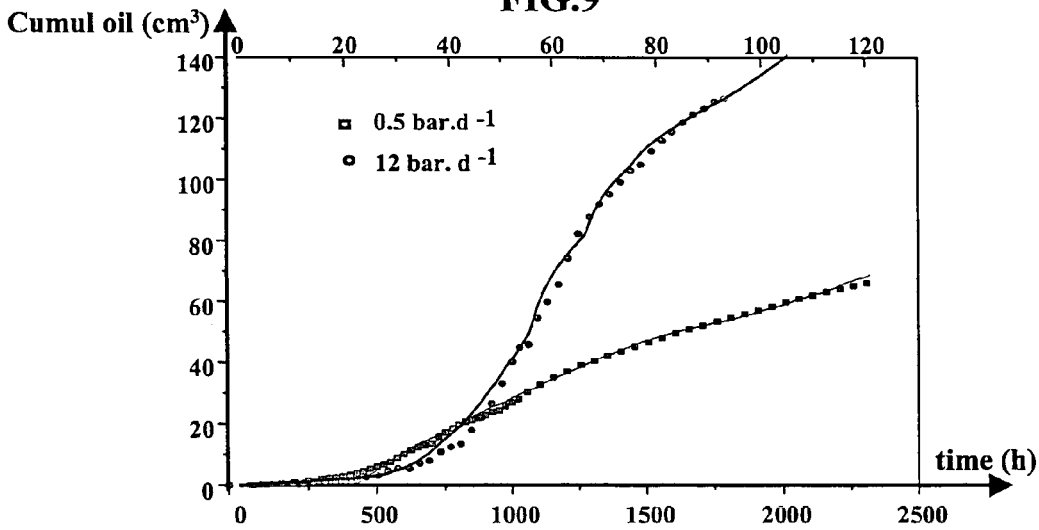
FIGS. 9 and 10 show a second series of simulations, the first one with an oil whose viscosity is about 1500 cp at 0.5 and 12 $bar \cdot j^{-1}$, the second with an oil whose viscosity is about 300 cp at 0.8 and 8 $bar \cdot j^{-}$.
Figure 10:
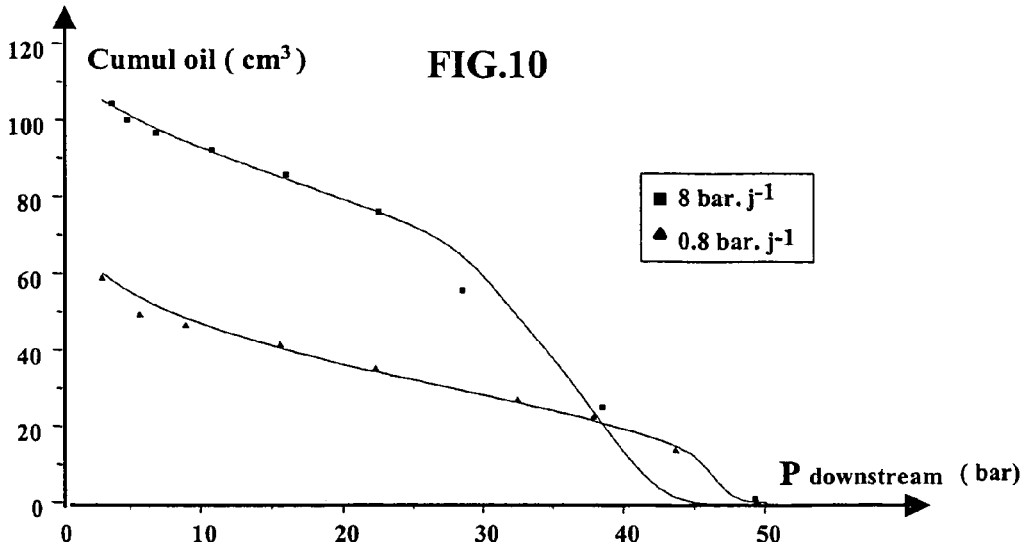

FIGS. 9 and 10 show that there is a good correlation between two series of experiments carried out from two different samples.

The invention claimed is:

1. A method for forming a model providing simulation of production by an underground reservoir, under an effect of depletion, comprising:

a) measuring respective volumes of oil and gas produced by rock samples from the reservoir subjected to the depletion, as well as relative permeabilities of rock samples to hydrocarbons;

b) determining, by a gas fraction flow model, a volume transfer coefficient by means of a pressure dependent empirical function that is calibrated with reference to the measurements of respective volumes of oil and gas, from which a distribution of nuclei that can be activated at a pressure is deduced;

c) determining a volume transfer coefficient in the reservoir at selected depletion rates, by means of the gas fraction flow model and by considering that distribution of microbubbles deduced from the measurements is identical to a distribution of nuclei in the reservoir rocks that corresponds to the volume transfer coefficient determined by the gas fraction flow model; and d) predicting the relative permeabilities in the reservoir and reservoir production by means of the volume transfer coefficient.

2. A method as claimed in claim 1, wherein the gas fraction flow model is described by a parameter characterizing a force required for untrapping the microbubbles, a parameter characterizing a change of a gas phase to a continuous form, the parameters being determined by calibration from the measurements, and by values of the relative permeability to a continuous gas fraction.

* * * * *